US011905104B2

(12) United States Patent
Cassoni et al.

(10) Patent No.: US 11,905,104 B2
(45) Date of Patent: Feb. 20, 2024

(54) METHOD OF MAKING AN AEROSOL DISPENSER

(71) Applicant: The Procter & Gamble Company, Cincinnati, OH (US)

(72) Inventors: Robert Paul Cassoni, Waynesville, OH (US); Matthew Aaron Neumann, Montgomery, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 18/102,185

(22) Filed: Jan. 27, 2023

(65) Prior Publication Data

US 2023/0174294 A1 Jun. 8, 2023

Related U.S. Application Data

(63) Continuation of application No. 17/006,938, filed on Aug. 31, 2020, now abandoned.
(Continued)

(51) Int. Cl.
*B65B 31/00* (2006.01)
*B65D 83/62* (2006.01)
(Continued)

(52) U.S. Cl.
CPC ..... *B65D 83/62* (2013.01); *B65B 31/003* (2013.01); *B65D 83/0061* (2013.01);
(Continued)

(58) Field of Classification Search
CPC ... B65B 3/045; B65B 31/003; B65D 83/0061; B65D 83/14; B65D 83/384; B65D 83/42; B65D 83/425; B65D 83/48; B65D 83/62
(Continued)

(56) References Cited

U.S. PATENT DOCUMENTS 4,969,577 A 11/1990 Werding
5,320,255 A 6/1994 Stoffel et al.
(Continued)

FOREIGN PATENT DOCUMENTS

CN 101987503 A 3/2011
CN 103534173 A 1/2014
(Continued)

OTHER PUBLICATIONS

15631 PCT Search Report and Written Opinion for PCT/US2020/048871 dated Dec. 22, 2020, 14 pages.
(Continued)

*Primary Examiner* — Stephen F. Gerrity
(74) *Attorney, Agent, or Firm* — William E. Gallagher

(57) ABSTRACT

A method and apparatus of making an aerosol container. A polymeric container may be provided. The container may have a closed end bottom and a neck longitudinally opposed to the closed end bottom. The container has an internal container volume. A valve and a bag may be provided and a portion of the valve and the bag may be disposed within the container. The bag has a first bag volume. A portion of the at least one of the neck and the bag may contact a portion of the valve to form a temporary seal. Propellant may be introduced into the container. The bag may be collapsed from the first bag volume to a second bag volume. The pressure of the propellant and the pressure within the bag equilibrate. The valve may be joined to the container and the propellant may be sealed within the container.

7 Claims, 7 Drawing Sheets

Related U.S. Application Data

(60) Provisional application No. 62/991,779, filed on Mar. 19, 2020, provisional application No. 62/899,768, filed on Sep. 13, 2019.

(51) Int. Cl.
*B65D 83/00* (2006.01)
*B65D 83/38* (2006.01)
*B65D 83/48* (2006.01)
*B65D 83/42* (2006.01)

(52) U.S. Cl.
CPC ..... *B65D 83/384* (2013.01); *B65D 83/425* (2013.01); *B65D 83/48* (2013.01)

(58) Field of Classification Search
USPC ..... 53/470; 141/3, 20
See application file for complete search history.

(56) References Cited

U.S. PATENT DOCUMENTS

| | | | | |
|---|---|---|---|---|
| 5,505,039 | A * | 4/1996 | Maier | B65B 31/00 53/470 |
| 6,196,275 | B1 | 3/2001 | Yazawa et al. | |
| 6,345,739 | B1 * | 2/2002 | Mekata | B65D 83/62 53/470 |
| 7,997,703 | B2 | 8/2011 | Naka et al. | |
| 8,459,501 | B2 | 6/2013 | Moretti | |
| 8,479,779 | B2 * | 7/2013 | Behar | B65B 31/003 53/470 |
| 8,869,842 | B2 | 10/2014 | Smith | |
| 9,475,636 | B2 * | 10/2016 | Mekata et al. | B65B 31/003 |
| 9,975,656 | B2 | 5/2018 | Smith et al. | |
| 10,071,850 | B2 | 9/2018 | Sugawara et al. | |
| 11,000,983 | B2 | 5/2021 | Zeik et al. | |
| 2002/0179151 | A1 | 12/2002 | Van | |
| 2012/0097706 | A1 | 4/2012 | Nimmo et al. | |
| 2012/0291911 | A1 | 11/2012 | Smith | |
| 2014/0209633 | A1 | 7/2014 | Mcdaniel | |
| 2015/0108163 | A1 | 4/2015 | Smith et al. | |
| 2015/0284235 | A1 | 10/2015 | Blackburn | |
| 2017/0129690 | A1 | 5/2017 | Sugawara | |
| 2018/0043604 | A1 | 2/2018 | Zeik | |
| 2018/0044096 | A1 | 2/2018 | Neumann et al. | |
| 2018/0044097 | A1 | 2/2018 | Zeik | |
| 2018/0222613 | A1 | 8/2018 | Geier et al. | |
| 2019/0285508 | A1 | 9/2019 | Mathe | |
| 2021/0078791 | A1 | 3/2021 | Cassoni et al. | |

FOREIGN PATENT DOCUMENTS

| | | | | |
|---|---|---|---|---|
| CN | 109562536 | A | 4/2019 | |
| CN | 109562886 | A | 4/2019 | |
| DE | 3307245 | A1 * | 9/1984 | B65B 31/003 |
| EP | 0754556 | A3 | 1/1998 | |
| GB | 1325712 | A | 8/1973 | |
| JP | 02127222 | A * | 5/1990 | B65D 83/42 |
| JP | H09118380 | A | 5/1997 | |
| JP | 2004131187 | A * | 4/2004 | |
| JP | 2008150119 | A | 7/2008 | |
| JP | 2011093610 | A | 5/2011 | |
| WO | 8810221 | A1 | 12/1988 | |

OTHER PUBLICATIONS

All Office Actions; U.S. Appl. No. 17/006,938, filed Aug. 31, 2020.

* cited by examiner

METHOD OF MAKING AN AEROSOL DISPENSER

FIELD

The present disclosure is directed to a method of making an aerosol dispenser, and, in particular, to a method of making an aerosol dispenser including a container, a valve, and a product delivery device such that the product delivery device does not interfere with joining the valve to the container.

BACKGROUND

Aerosol dispensers typically comprise a container which acts as a pressure vessel for propellant and product contained therein. A valve assembly may be joined to a container to seal product and/or propellant within the container and to allow for selective dispensing of the product and/or propellant from the container. A product delivery device may be used to dispense the product and/or propellant from the container. The product delivery device may include a bag. The bag may be configured to hold product and/or propellant. The bag may be collapsible such that the bag changes volume during the manufacture of the aerosol dispenser.

During the manufacture of the aerosol dispenser, product and propellant are introduced into the container. However, the sequence of introducing these materials and the collapsible nature of the bag may result in the bag interfering with the joining of the valve assembly to the container. Interference of the bag with the joining of the valve assembly to the container may result in improper joining of the valve assembly and the container, which may result in a defective seal between the valve assembly and the container such that propellant and/or product unintentionally leaks from the dispenser. Further, the bag may become damaged upon interference with the joining of the valve assembly and the container. For example, the bag may tear upon interfering with the joining of the valve assembly and the container.

Thus, it would be beneficial to provide an apparatus and a method for controlling the collapse of the bag during manufacture of the aerosol dispenser.

SUMMARY

In some embodiments, a method of making an aerosol container may include: providing a polymeric container having a closed end bottom and a neck longitudinally opposed to the closed end bottom, wherein the neck defines an opening, and wherein the container has an internal container volume; providing a valve and a bag, wherein at least a portion of the valve and the bag are disposed in the opening of the neck, wherein the bag has a first bag volume; contacting a portion of at least one of the neck and the bag to a portion of the valve to form a temporary seal; introducing a propellant into the container; collapsing the bag from the first bag volume to a second bag volume, and wherein the second bag volume is less than the first bag volume; and joining the valve to the container to seal the valve to the container, wherein the propellant is sealed within the container.

In some embodiments, a method of making an aerosol container may include: providing a polymeric container having a closed end bottom and a neck longitudinally opposed to the closed end bottom, wherein the neck defines an opening; providing a valve and a bag, wherein at least a portion of the valve and the bag are disposed in the opening of the neck; contacting a portion of at least one of the neck and the bag to a portion of the valve to form a temporary seal; introducing a propellant into the container; positioning the valve in an open configuration; collapsing the bag, wherein at least a portion of a fluid contained within the bag is released through the valve; and joining a portion of the valve to a portion of the container to seal the propellant within the container.

In some embodiments, a method of making an aerosol container may include: providing a polymeric container having a closed end bottom and a neck longitudinally opposed to the closed end bottom, wherein the neck defines an opening, wherein the container has an internal container volume; providing a valve and a bag, wherein at least a portion of the valve and the bag are disposed in the opening of the neck; contacting a portion of at least one of the neck and the bag to a portion of the valve to form a temporary seal; providing a fluid chamber having a fluid chamber volume; engaging at least a portion of at least one of the valve and the container with the fluid chamber; positioning the valve in an open configuration; introducing a propellant into the container; releasing a fluid from the bag through the valve and into the fluid chamber; and joining the valve to the container to seal the valve to the container, wherein the propellant is sealed within the container.

In some embodiments, a method of making an aerosol container may include: providing a polymeric container having a closed end bottom and a neck longitudinally opposed to the closed end bottom, wherein the neck defines an opening; providing a valve and a bag, wherein at least a portion of the valve and the bag are disposed in the opening of the neck; contacting a portion of at least one of the neck and the bag to a portion of the valve to form a temporary seal; positioning the valve in an open configuration; decreasing the pressure within the bag; introducing a propellant into the container; and joining the valve to the container to seal the valve to the container, wherein the propellant is sealed within the container.

DETAILED DESCRIPTION

Figure 1B:
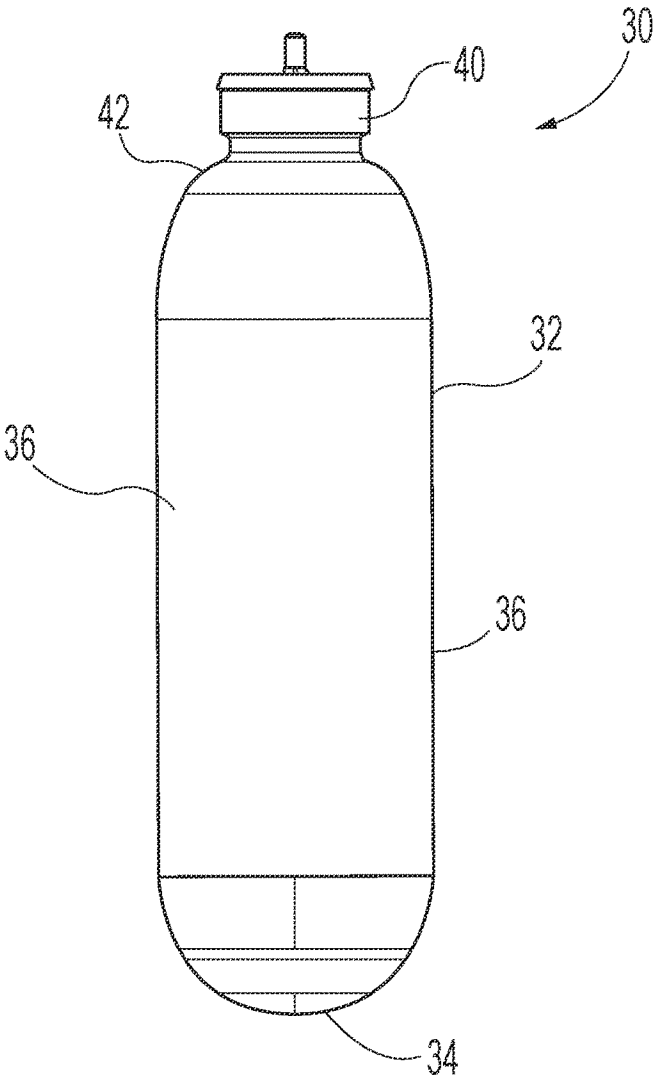
FIG. 1B is a side view of an aerosol dispenser.
Figure 1A:
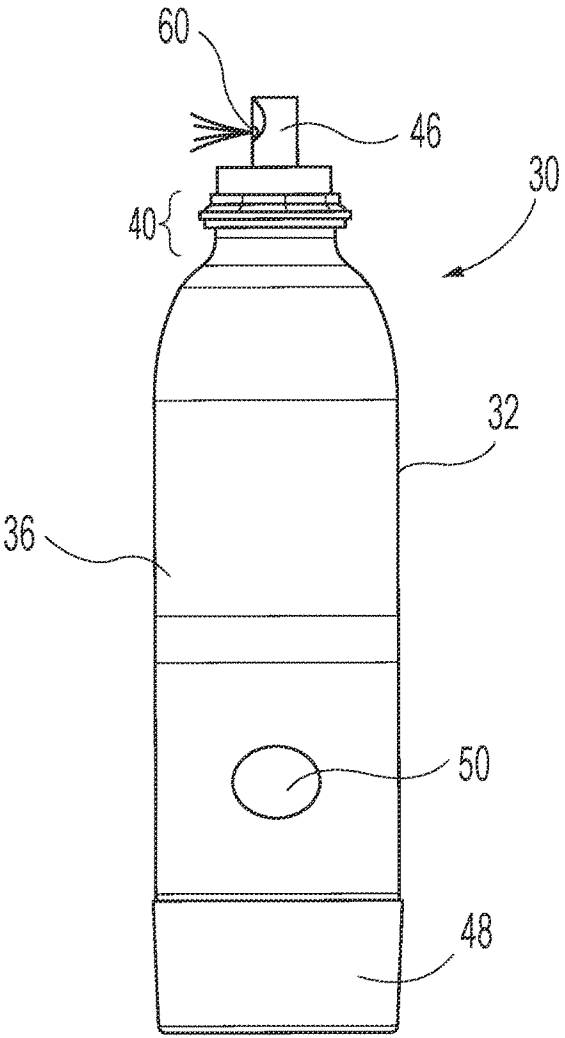
FIG. 1A is a side view of an aerosol dispenser.

The present disclosure is directed to an aerosol dispenser and, more specifically, an apparatus and method for manufacturing an aerosol dispenser. An aerosol dispenser may include a container for containing a product and a propellant and a valve assembly for dispensing the product or the product and the propellant from the container. Other components may be included in the aerosol dispenser such as a nozzle for controlling the spray characteristics of a product as it discharged from the aerosol dispenser and an actuator for selectively dispensing product from the aerosol dispenser. Products may include, but are not limited to: shave cream, shave foam, body sprays, body washes, perfumes, hair cleaners, hair conditions, hair styling products, antiperspirants, deodorants, personal and household cleaning or disinfecting compositions, air freshening products, fabric freshening products, hard-surface products, astringents, foods, paint, pharmaceuticals, and insecticides. The relatively large number of products that may be dispensed using aerosols has made aerosols a popular choice among manufacturing companies. The relative popularity of aerosol dispensers has resulted in companies considering cost cutting measures with respect to aerosol dispensers and to consider materials, at least in part, for aerosol dispensers to minimize the environmental impact. For example, an aerosol dispenser made from polymeric components may aid in the recyclability of the dispensers and help with reducing cost, such as by reducing the cost of manufacturing, eliminating expensive metal components, and reducing the cost of shipping, through weight reduction of each dispenser. The use of different materials also allows for greater flexibly in the size and shape of the dispenser.

One way to relatively reduce cost is to optimize the manufacturing process and/or equipment for aerosol dispensers. The present disclosure is directed to a method and apparatus that reduces the time need to pressurize and seal the container of the aerosol. More specifically, the pressurizing of the container and the joining of the valve assembly to the container may be completed substantially simultaneously or, stated another way, at a single station within the manufacturing process. Further, the process may be used to control the components of the aerosol container such that the integrity of the seal and the bag are not adversely affected. The process and equipment controls the volume and/or pressure within the bag to prevent the bag from being adversely affected during the sealing process while allowing for sufficient pressurization of the container with a propellant.

With reference to FIGS. 1A, 1B, 2, and 3, an aerosol dispenser 30 may include a container 32, a valve assembly 52 (also referred to herein as a valve), a product delivery device 56, an actuator 46, and a nozzle 60. The container 32 may include a base cup 48 joined thereto and indicia 50 disposed on, for example, the sidewalls, 36 of the container 32. The container 32 may define an internal container volume and be configured to hold a fluid, which includes liquids and gases or another other freely flowing material. The valve assembly 52 may be joined to a portion of the container 32. The term joined includes directly or indirectly joined. Joined includes removably joined and fixedly joined. Joined includes both mechanical attachment, such as by screws, bolts, interference fit, friction fit, welding, and integrally molding, and chemical attachment, such as by adhesive or the adhesive properties inherent in the materials being attached. The valve assembly 52 may be joined to the container 32 such that a portion of the valve assembly 52 is disposed within the container 32. The product delivery device 56 may be joined to at least one of a portion of the container 32 and a portion of the valve assembly 52, and the product delivery device may be in fluid communication with the actuator 46 and the nozzle 60.

A base cup 48 may be joined to the bottom portion, which is opposite the valve assembly 52, of the container 32 and may be used, for example, to aid in positioning the dispenser on flat surfaces and to reinforce the bottom 34 of the aerosol dispenser. The container 32 may be configured to hold product and/or propellant. The product delivery device may be disposed at least partially within the container and the valve may be joined to the container 32 and may be in operative communication with the product delivery device. The product and/or the propellant may be stored in the container 32. Upon being dispensed, the product and/or propellant may travel from and/or through the product delivery device 56 and through the valve assembly 52.

The valve assembly 52 may be in fluid communication with a nozzle 60. The nozzle 60 directs product out of the aerosol dispenser and into the environment or onto a target surface. The nozzle may be configured in various different ways depending upon the desired dispensing and spray characteristics. The actuator 46 may be engaged by a user and is configured to initiate and terminate dispensing of the product and/or propellant. Stated another way, the actuator provides selective dispensing of the product and/or propellant. The actuator 46 may be depressible, operable as a trigger, push-button, and the like, to cause release of a product from the aerosol dispenser 30. The actuator 46 may include a connector such as a male or female connector, snap-fit connector, or the like to secure the actuator to the container 32. It is to be appreciated that to dispense product, the aerosol dispenser does not need to include an actuator and a nozzle. The product and/or propellant may be dispensed from the stem.

The container 32 may be used to hold product and/or propellant. The container 32 may be any shape that allows product and/or propellant to be held within the interior of the container 32. For example, the container 32 may have a cross-sectional circular-shape, peanut-shape, oval-shape, or rectangular-shape. It is to be appreciated that the container 32 may be molded, which allows for any number of shapes to be used. The container 32 may be longitudinally elongate such that the container has an aspect ratio of a longitudinal dimension to a transverse dimension, such as diameter. The aspect ratio may be greater than 1, equal to 1, such as in a sphere or shorter cylinder, or an aspect ratio less than 1. The containers 32 may be cylindrical.

The container 32 may include a closed bottom 34, one or more sidewalls 36, and a neck 40. The one or more sidewalls 36 may extend between the closed bottom 34 and the neck 40. The sidewalls 36 define the shape of the container 32. A shoulder 42 may be included between the neck 40 and the one or more sidewalls 36. The neck 40 of the container 32 may define an opening 38. The opening 38 may be opposite the bottom 34 of the container 32. The neck 40 and/or shoulder 42 may have a uniform or varying thickness in order to achieve a desired strength in these regions of the container 32.

The bottom 34 of the container 32 may be configured for resting on horizontal surfaces such as shelves, countertops, tables etc. The bottom 34 of the container 32 may include a re-entrant portion or base cup 48. The base cup 48 may be joined to the bottom 34 of the container 32 and may aid in reinforcement of the bottom 34 and/or may allow the container to rest on horizonal surfaces. The container 32 may not include a base cup and may be configured to sit on at least a portion of the bottom 34. Suitable shapes of the bottom 34 include petaloid, champagne, hemispherical, or other generally convex shapes. Each of these shapes of the bottom 34 may be used with or without a base cup 48. The container 32 may have a generally flat base with an optional push-up.

The container 32 may be polymeric. The container 32 may include polyethylene terephthalate (PET), polyethylene furanoate (PEF), polyester, nylon, polyolefin, EVOH, polypropylene, polyethylene, or mixtures thereof. The container 32 may be a single layer or multi-layered. The container 32 may be injection molded or further blow molded, such as in an injection-stretch blow molding process or an extrusion blow molding process.

The container 32 may be axisymmetric as shown, or, may be eccentric. The cross-section may be square, elliptical, irregular, etc. Furthermore, the cross section may be generally constant as shown, or may be variable. For a variable cross-section, the container 32 may be, for example, barrel shaped, hourglass shaped, or monotonically tapered.

The container 32 may range from about 6 cm to about 60 cm, or from about 10 cm to about 40 cm in height, taken in the axial direction. The container 32 may have a cross-section perimeter from about 3 cm to about 60 cm, or from about 4 cm to about 10 cm. The container 32 may have a volume ranging from about 40 cubic centimeters to about 2000 cubic centimeters exclusive of any components therein, such as a product delivery device 56.

At 21° C., the container 32 may be pressurized to an internal gage pressure of about 100 kPa to about 1500 kPa, or from about 110 kPa to about 1300 kPa, or from about 115 kPa to about 490 kPa, or about 270 kPa to about 420 kPa using a propellant. An aerosol dispenser 30 may have an initial propellant pressure of about 1500 kPa and a final propellant pressure of about 120 kPa, an initial propellant pressure of about 900 kPa and a final propellant pressure of about 300 kPa, or an initial propellant pressure of about 500 kPa and a final propellant pressure of 0 kPa, including any values between the recited ranges.

The propellant may include hydrocarbons, compressed gas, such as nitrogen and air, hydro-fluorinated olefins (HFO), such as trans-1,3,3,3-tetrafluoroprop-1-ene, and mixtures thereof. Propellants listed in the US Federal Register 49 CFR 1.73.115, Class 2, Division 2.2 may be acceptable. The propellant may be condensable, which is a propellant that exists at multiple phases at standard operating pressures and temperatures of an aerosol dispenser. The propellant may be condensable at pressures less than 1500 kPa at 21° C. A condensable propellant, when condensed, may provide the benefit of a flatter depressurization curve at the vapor pressure, as product is depleted during usage. A condensable propellant may provide the benefit that a greater volume of fluid may be placed into the container at a given pressure. Generally, the highest pressure occurs after the aerosol dispenser is charged with product but before the first dispensing of that product by the user.

Figure 3:
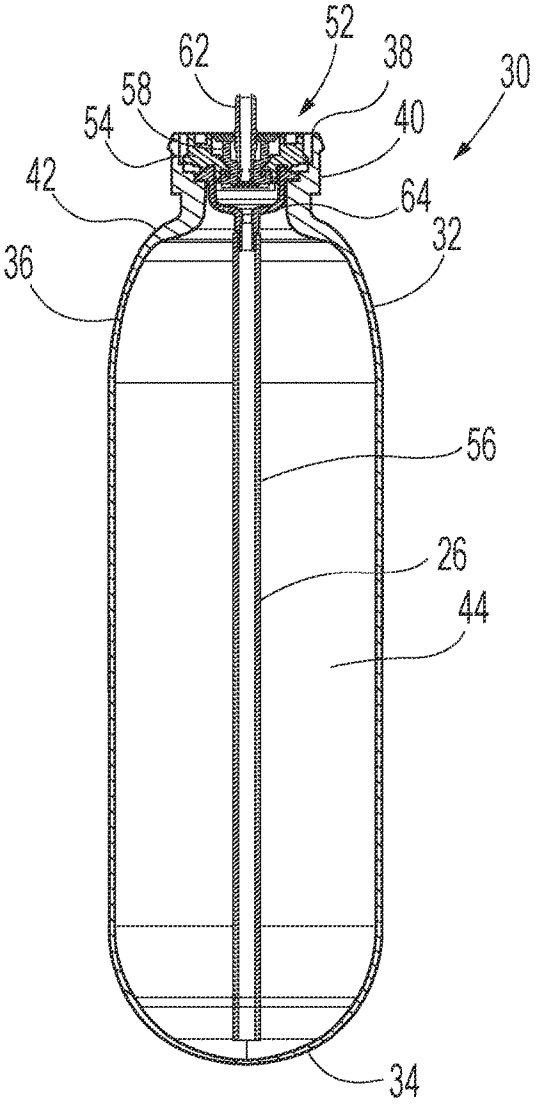
FIG. 3 is a sectional view of an aerosol dispenser including a dip tube.
Figure 2:
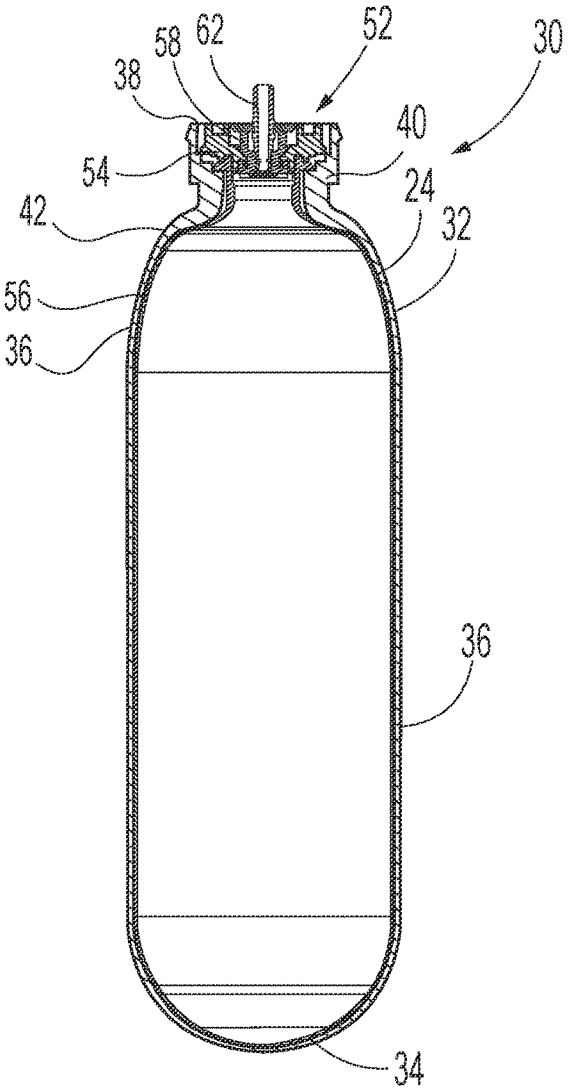
FIG. 2 is a sectional view of an aerosol dispenser including a bag.

The product delivery device 56 may be used to contain and/or provide for delivery of product and/or propellant from the aerosol dispenser 30 upon demand. Suitable product delivery devices 56 comprise a piston, a bag 24, or a dip tube 26, such as illustrated in FIGS. 2 and 3. It is to be appreciated that either the bag 24 or the dip tube 26 may be attached to an adaptor 64. The bag 24 or the dip tube 26 may be directly joined to the valve assembly 52 or the bag 24 and the dip tube 26 may be indirectly joined to the valve assembly 52. The bag 24 or the dip tube 26 may be attached to an adaptor 64 and the adaptor 64 may be joined to the valve assembly 52. The product delivery device 56 may include polyethylene terephthalate (PET), polypropylene (PP), polypropylene (PP), polyethylene furanoate (PEF), polyester, nylon, polyolefin, EVOH, or mixtures thereof. The container 32 may be a single layer or multi-layered.

As illustrated in FIG. 2, the product delivery device may be a bag 24. The bag 24 may be disposed within the container 32 and be configured to hold a product therein. Propellant may be disposed within the container 32 and between the container and the bag 24. A portion of the bag 24 may be joined to at least one of the container 32 and a portion of the valve assembly 52, such as the valve body 54. The bag 24 may be positioned between the container 32 and the valve body 54. The bag 24 may be inserted into the container 32 and subsequently joined thereto. The bag 24 may be joined to the valve body 54, and the valve body 54 joined to the bag 24 may be subsequently inserted into the container 32.

As illustrated in FIG. 3, the dispenser may include an adaptor 64 and a dip tube 26. The adaptor 64 may be disposed within the container 32. The adaptor 64 may engage a portion of the neck 40. The dip tube 26 may be joined to the adaptor 64 and extend from the adaptor 64 toward the bottom 34 of the container 32. It is to be appreciated that the dip tube 26 may be attached directly to a portion of the valve assembly, such as the valve body 54. The dip tube 26 and/or the adaptor 64 may be attached to the valve body 54 prior to being disposed within the container. The dip tube 26 and/or the adaptor 64 may be disposed within the container and then subsequently joined to a portion of the container 32 and/or the valve body 54.

The product delivery device 56 may include a metering device for dispensing a predetermined, metered quantity of product. The product delivery device 56 may include an inverting valve such as a valve including a ball therein to alter the path of product flow. The product delivery device 56 may include a dip tube disposed in a bag. The product delivery device 56 may be polymeric.

The container 32, and/optionally the product delivery device 56 may be transparent or substantially transparent. This arrangement provides the benefit that the consumer knows when product is nearing depletion and allows improved communication of product attributes, such as color, viscosity, etc. Also, indicia disposed on the container 32, such as labeling or other decoration of the container 32, may be more apparent if the background to which such decoration is applied is clear. Labels may be shrink wrapped, printed, etc., as are known in the art.

The container 32 may include a neck 40. The neck 40 may define an opening 38 and be configured to receive a valve assembly 52. The valve assembly 52 may be inserted, at least partially, into the opening 38 of the neck 40 of the container 32, such as illustrated in FIGS. 2 and 3. The valve assembly 52 may include a valve body 54, a valve stem 62, and a resilient member 58. At least a portion of the valve assembly 52 may be movable in relationship to the balance of the aerosol dispenser in order to open and close the aerosol dispenser for dispensing product. The valve assembly 52 may be opened due to movement of the valve stem 62 which may be through use of an actuator 46 or through manual or other mechanical depression of the valve stem 62. When the valve 52 is opened, for example, by way of the actuator 46, a flow path is created for the product to be dispensed through a nozzle 60 to ambient or a target surface. The valve assembly 52 may be opened, for example, by selective actuation of the actuator 46 by a user.

A portion of the valve body 54 may be sealed to the neck of the container 32, such as illustrated in FIGS. 2 and 3, to prevent the escape of propellant, product, and the loss of pressurization. The valve body 54 may be sealed to the container 32 utilizing a press fit, interference fit, solvent welding, laser welding, sonic welding, ultrasonic welding, spin welding, adhesive or any combination thereof, so long as a seal adequate to maintain the pressure results. The valve body 54 may be joined to the container 32 such that at least a portion of the valve body 54 is disposed within the container 32. The valve body 54 may be joined to the container 32 such that the valve body 54 is joined to the opening of the neck and at least a portion of the valve body 54 is disposed on top of the neck.

Figure 4:
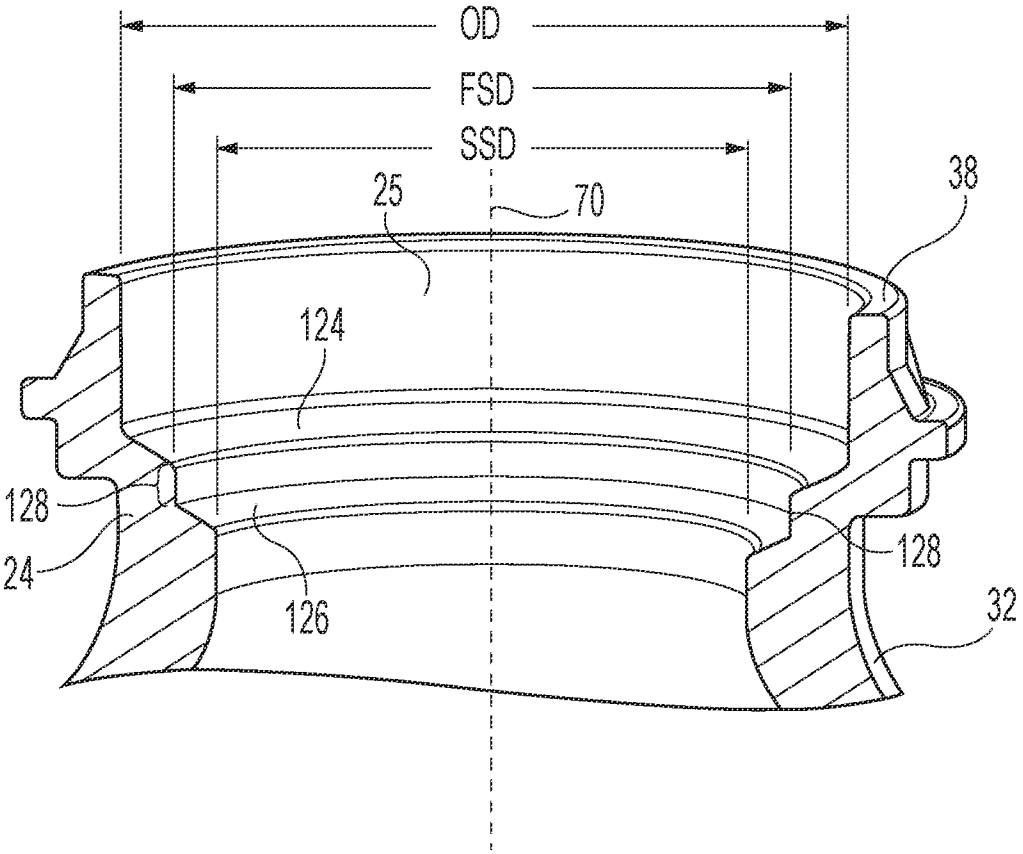
FIG. 4 is a partial, sectional view of a neck of a container.

As illustrated in FIG. 4, the container 32 may include a first support surface 124 that extends about the longitudinal axis 70. The first support surface 124 may be positioned between the opening 38 of the container 32 and the bottom 34 of the container 32. The first support surface 124 may be positioned within the opening 38 such that the opening diameter OD is greater than the first support surface diameter FSD. The container 32 may include a second support surface 126 that extends about the longitudinal axis 70. The second support surface 126 may be positioned between the first support surface 124 and the bottom 34 of the container 32. The second support surface may be positioned within the opening 38 such that the opening diameter OD is greater than the second support surface diameter SSD. The first support surface diameter FSD may be greater than the second support surface diameter SSD. The first support surface 124 may be configured to support a portion of the valve assembly 52. The second support surface 126 may be configured to support a portion of the valve assembly 52 and/or the product delivery device 56. The first support surface 124 may be joined to a portion of the valve assembly 52, such as the valve body 54. The second support surface 126 may be joined to at least one of a portion of the valve assembly 52, such as the valve body 54, and the product delivery device 56. It is to be appreciated that the first support surface 124 may be joined to a portion of the valve assembly 52, such as the valve body, and the second support surface 126 may be used to support at least one of the valve assembly 52 and the product delivery device 56. The second support surface 126 may not be joined to the valve assembly 52 or the product delivery device 56 and, rather, may support the valve assembly 52 and/or the product delivery device 56.

The first support surface 124 may circumscribe the second support surface 126. The first support surface 124 may be in the same plane as the second support surface 126 or may be in a different plane. The first support surface 124 may be above the second support surface 126. The first support surface 124 may be disposed radially outward of the second support surface 126.

The first support surface 124 may be concentric to the longitudinal axis and, for example, frustoconical, as illustrated in FIG. 4. This arrangement provides the benefit that a valve assembly 52 disposed thereon will seat to the lowest position, i.e. having the smallest diameter. The valve assembly 52 may be disposed in the proper position without a separate step required in the manufacturing process. The second support surface 126 may be concentric to the longitudinal axis and, for example, frustoconical, as illustrated in FIG. 4. This arrangement provides the benefit that a component disposed thereon may seat concentric with and below the first support surface 124. The product delivery device may be disposed in the proper position without a separate step required in the manufacturing process. The first support surface 124 and the second support surface 126 may be substantially perpendicular to the longitudinal axis. The first support surface 124 and the second support surface 126 may form any angle with respect to the longitudinal axis such that the valve assembly 52 and the product delivery device 56 may be supported by and/or joined to the container 32 and product and/or propellant may be sealed within the container 32. The first support surface 124 and second support surface 126 may be contiguous. More particularly, the first support surface 124 and second support surface 126 may be mutually integral and integral with the outer container 32.

The first support surface 124 may be the opening of the container. Further, a single support surface may be used to join the valve assembly to the container.

As illustrated in FIG. 4, the container 32 may include a transition 128 between the first support surface 124 and the second support surface 126. The transition 128 is any discernable break that separates the first support surface 124 and the second support surface 126. The transitions 128 may provide the benefit that each of the first support surface 124 and second support surface 126 may be specifically tailored to its particular function of sealingly retaining the valve assembly 52 and product delivery device 56. The transition 128 may include a step between the first support surface 124 and the second support surface 126. The step may be a longitudinal break, between a mutually parallel or mutually skewed first support surface 124 and second support surface 126.

The first support surface 124, the second support surface 126, and the transition 128 may include one or more surface profiles to aid in sealing the valve to the container 32 and/or to allow fluid, such as propellant, to be introduced into the container 32 and/or to aid in positioning the components with respect to one another, for example the product delivery device with respect to the container. For example, the one or more surface profiles may include ridges, grooves, protrusions, and/or added surface roughness.

Figure 5A:
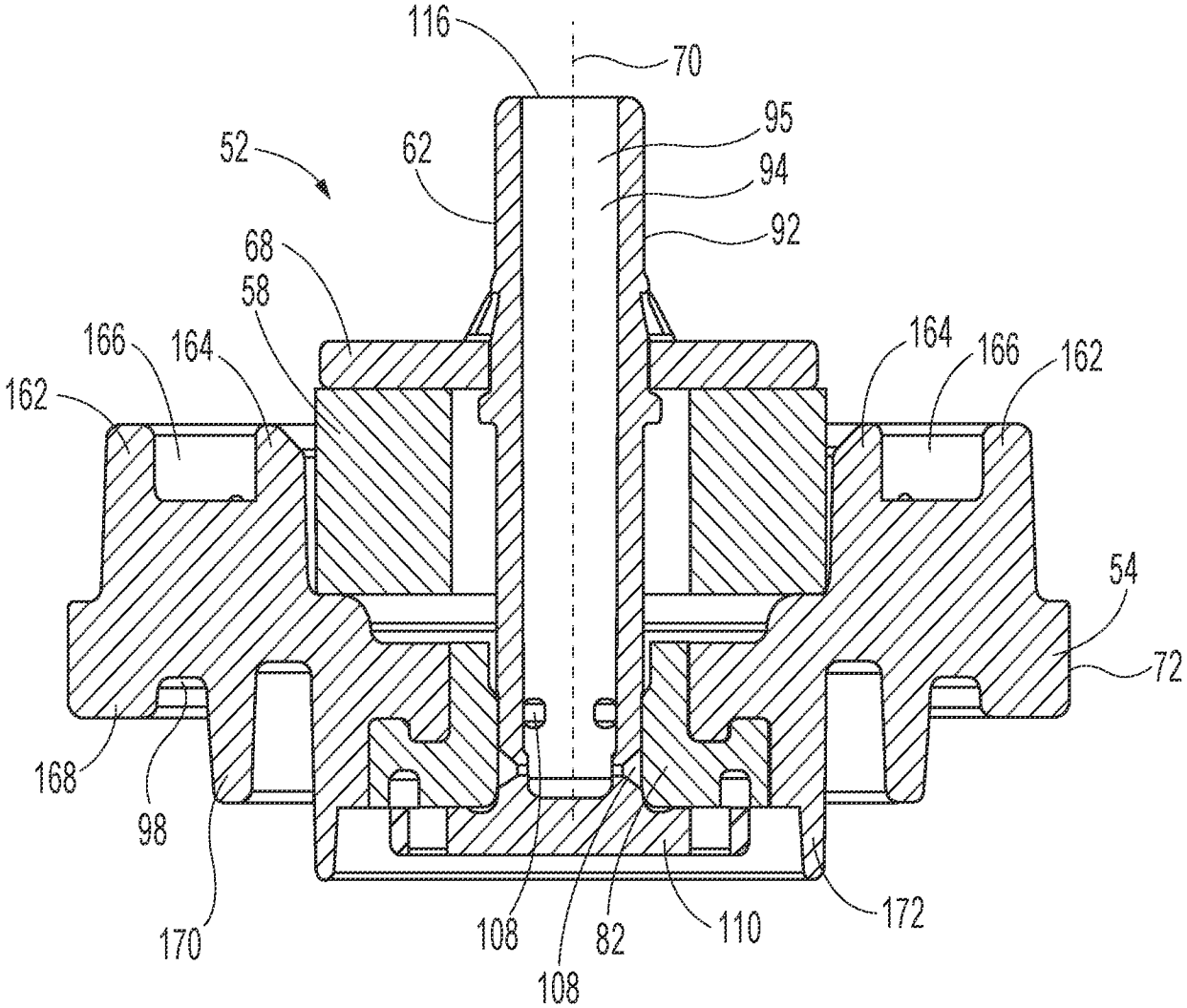
FIG. 5A is a sectional view of a valve assembly.
Figure 5B:
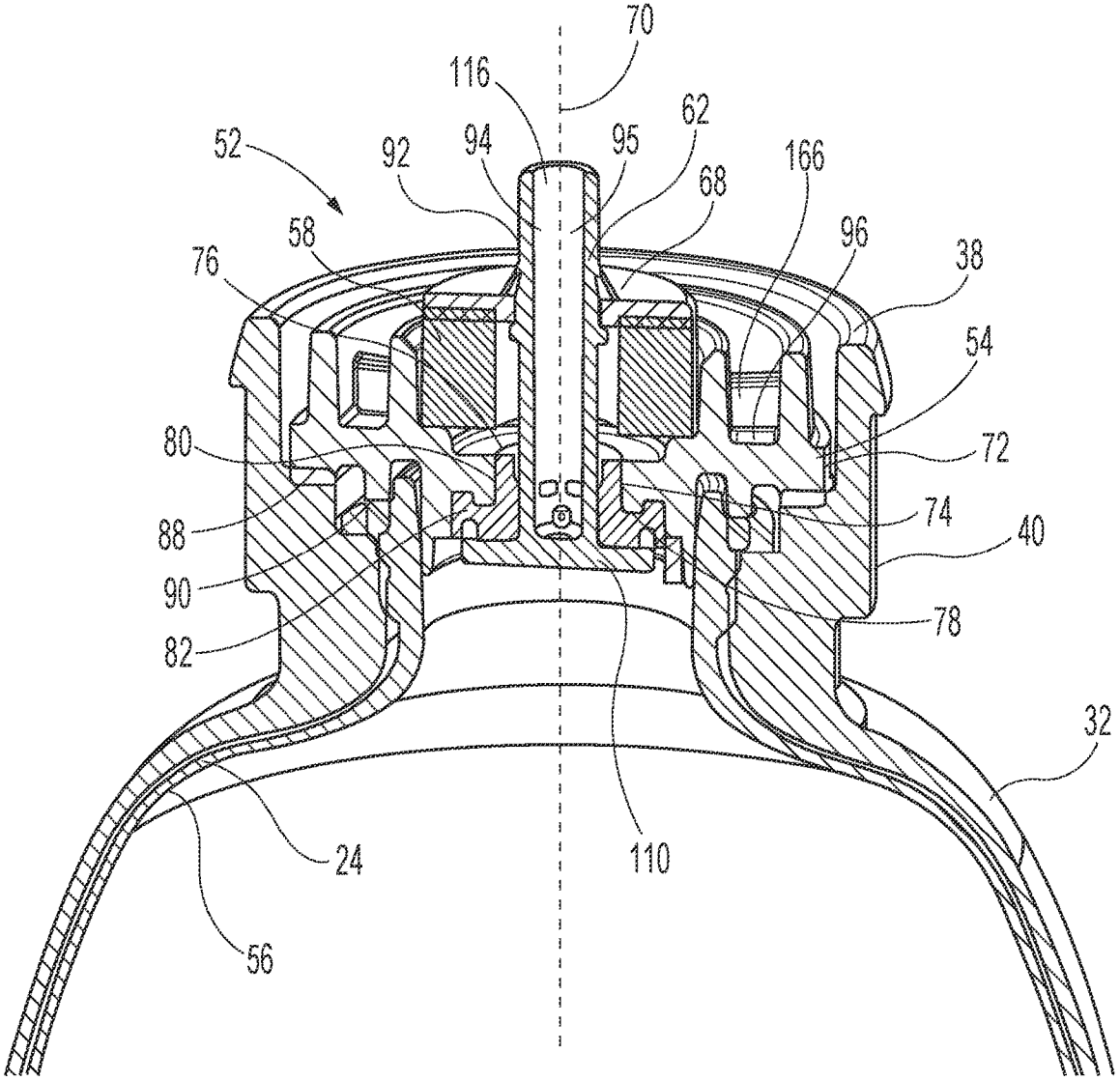
FIG. 5B is a perspective, sectional view of a valve assembly disposed in a container.

The valve assembly 52, including a valve body 54, may be joined to the container 32. Referring to FIGS. 5A and 5B, the valve body 54 may extend about a longitudinal axis 70. The valve body 54 may include an outer surface 72 and define an inner passageway 74. The outer surface 72 may include the surface positioned farthest from the longitudinal axis 70. The outer surface 72 may extend about the longitudinal axis 70. The inner passageway 74 may include a first passageway opening 76 and a second passageway opening 78 and a passageway surface 80 extending from the first passageway opening 76 to the second passageway opening 78. The passageway surface 80 may substantially surround the longitudinal axis 70.

A valve stem 62 may extend through the inner passageway 74 of the valve body 54. The valve stem 62 provides a product flow path from the interior of the container 32 to the nozzle 60 and operatively joins the actuator 46 to the valve assembly 52. The valve stem 62 may be positioned with respect to the valve body 54 in a closed or sealed configuration such that a portion of the valve stem 62 extends through the first passageway opening 76 of the valve body 54, a second portion of the valve stem 62 may be substantially surrounded by the passageway surface 80, and a third portion of the valve stem 62 may extend through the second passageway opening 78 of the valve body 54. The valve stem 62 may be moveable with respect to the valve body 54, for example between a closed or sealed configuration and/or an open configuration. A closed or sealed configuration is one in which the product and/or propellant is contained within the container 32 and no flow path is provided to dispense product and/or propellant from the container 32. An open configuration is one in which product and/or propellant may be dispensed from the container 32 to the environment. An open configuration includes a dispensing configuration and a filling configuration. Thus, the valve stem 62 may be positioned in other configurations as the valve stem 62 moves. The valve stem 62 may include an outer stem surface 92 and an inner stem surface 94 opposite the outer stem surface. The inner stem surface 94 may define a channel 95 through which product and/or propellant may flow either out from or into the container 32. The valve stem 62 may include a dispensing opening 116 that may be used to introduce propellant and/or product into the container 32 or dispense product and/or propellant from the container 32.

The valve assembly 52 may include a valve seal 82, such as illustrated in FIGS. 5A and 5B. The valve seal may be disposed on at least a portion of the passageway surface 80 and may extend about at least a portion of the passageway surface 80. The valve seal may be joined to the passageway surface 80 such that the valve seal remains in position as the valve stem 62 moves from the closed configuration to an open configuration. The valve seal may extend from the passageway surface 80 toward the second passageway opening 78. The valve seal 82 may extend about the second passageway opening 78. The valve seal 82 may extend from the passageway surface 80 to the first passageway opening 76. The valve seal 82 may extend about the second passageway opening 78 without extending from the passageway surface 80. The valve seal 82 may be any shape such that a seal is formed with a portion of the valve stem 62 and product and/or propellant is contained within the container 32.

The valve assembly 52 may include a resilient member 58. The resilient member 58 may be disposed on a portion of the valve body 54. The resilient member 58 may be positioned adjacent to the first passageway opening 76 and substantially surround the longitudinal axis 70. The resilient member 58 may be any compliant member that provides resistance to a force providing movement of the valve stem 62 when the valve stem 62 is moved, such as to an open configuration, and returns the valve stem 62 to a closed configuration, also referred to herein as a sealed configuration, when the force is removed or lessened. The resilient member 58 may be made from at least one of a metal and a polymer. The resilient member 58 may be made from an elastomer such as a thermoplastic elastomer (TPE). The resilient member 58 may be any shape such that the resilient member 58 controls the movement of the valve stem.

The valve assembly 52 may include an engagement member 68. The engagement member 68 may be joined to a portion of the valve stem 62 such that the engagement member 68 moves as the valve stem 62 moves. The engagement member 68 may extend from the outer stem surface 92 towards the outer surface 72 of the valve body 54. The engagement member 68 may be axisymmetric or non-axisymmetric. The engagement member 68 is configured to operatively engage a portion of the resilient member 58. The resilient member 58 may be positioned between the engagement member 68 and a portion of the valve body 54.

When the valve stem 62 is in a closed configuration, the engagement member 68 may operatively engage the resilient member 58 such that the resilient member 58 is placed under a desired amount of compression which biases the valve stem 62 to remain in a position such that a seal is maintained. When the valve stem 62 is in a dispensing configuration, a user or other mechanical device may overcome an additional compression force of the resilient member to move the valve stem 62 from the sealing configuration to the dispensing configuration. As the valve stem 62 moves from the sealing configuration to the dispensing configuration, the engagement member 68 compresses the resilient member 58. It is also to be appreciated that the resilient member 58 may be further compressed to move the valve stem 62 from a dispensing configuration to a filling configuration.

The valve stem 62 may include one or more orifices 108. The orifices 108 may be used for filling the container 32 with product and/or propellant and dispensing product and/or propellant from the container 32. The one or more orifices 108 may be any shape or size so long as product and/or propellant may be at least one of filled and dispensed through such orifice. For example, the one or more orifices may be circular, oval, rectangular, square, or any other shape. The one or more orifices 108 may be tapered. For a valve stem 62 including two or more orifices, each of the orifices may be the same or different shapes and may be the same or different sizes. For example, when both a dispensing orifice and a filling orifice are included in the valve stem 62, the filling orifice may have a larger cross-sectional open area than the dispensing orifice. The orifice 108 may extend from the outer stem surface 92 to the inner stem surface 94. The orifice 108 may be in fluid communication with the channel 95 defined by the inner stem surface 94 such that product and/or propellent may flow through the orifice and into the channel 95. The product and/or propellant may flow from the container 32, through the orifice, and into the channel 95. The product and/or propellant may also flow through the channel, through the orifice, and into the container 32.

The one or more orifices 108 may be positioned about the valve stem 62 such that the release of product and/or propellant is controlled. The orifice 108 may be positioned between the dispensing opening 116 of the valve stem 62 and at least a portion of the valve seal 82. Stated another way, the one or more orifices 108 may be positioned such that at least a portion of the valve seal 82 is located between the orifice and the portion of the valve stem 62 adjacent to the retaining member 110 or the portion of the valve stem 62 adjacent to the interior of the container 32 to prevent product and/or propellant from freely flowing from the container 32 and through the orifice. The portion of the valve seal 82 positioned between the orifice and the bottom portion of the valve stem prevents product and/or propellant from flowing to the orifice prior to the valve stem being moved to an open configuration. When the valve stem is in a closed configuration, the valve seal 82 prevents product and/or propellant from accessing the orifice and contains the product and/or propellant within the container 32. A second portion of the valve seal 82 may be located between the orifice and the dispensing opening 116 of the valve stem to prevent product and/or propellant from freely flowing through the inner passageway 74 and out the first passageway opening 76 as product and/or propellant flow through the orifice.

The valve stem 62 may include a retaining member 110. The retaining member 110 may be joined to the portion of the valve stem 62 adjacent the container or the retaining member 110 may be formed with the remainder of the valve stem 62. The retaining member 110 may be formed from the same material as the other portions of the valve stem 62 or with a different material. For example, the retaining member 110 may be formed, at least in part, with a first material and the remainder of the valve stem 62 may be formed with one or more other materials that are different from the first material. The first material may have a melting point or a glass transition temperature (Tg) that is lower than the one or more other materials to allow at least the portion of the retaining member including the first material to melt, soften, deflect, or deform at a given temperature that is relatively lower than the remainder of the valve stem 62 or the valve body 54.

At least a portion of the retaining member 110 may extend outward, such as radially outward, beyond the outer stem surface 92 and may be configured to engage a portion of the valve body 54 and/or the valve seal 82. The retaining member may be axisymmetric or non-axisymmetric. The retaining member 110 may work in cooperation with the resilient member 58 to position the valve stem 62 in a sealed position. The retaining member 110 may be any shape such that a portion of the retaining member 110 may operatively engage at least one of a portion of the valve body 54 and the valve seal 82. The shape of the retaining member 110 may be such that the retaining member 110 maintains the position of the valve stem 62 during safe operating conditions and aids in safely moving the valve stem to vent the container during adverse operating conditions, such as relatively elevated temperatures and over pressurization of the aerosol dispenser.

The product delivery device 56 may be joined to at least one of the valve assembly 52 and the container 32. The product delivery device 56 and the valve assembly 52 may be disposed, at least in part, in the neck of the container 32. For example, such as illustrated in FIG. 5B, the bag 24 may be disposed in the container such that a portion of the bag 24 is joined to the neck 40 of the container 32 and a portion of the bag 24 extends into the container 32. The valve assembly 52 may be disposed on at least one of a portion of the bag 24 and a portion of the neck 40. The bag and the valve assembly are in fluid communication. Similarly, a dip tube may be disposed in the container 32. The dip tube may be a unitary member or may be a multi-piece member. A portion of the dip tube extends into the container 32 and a portion of the dip tube, such as the adaptor, is joined to at least one of the neck 40 of the container 32 and the valve body 54. The valve assembly 52 may be disposed on at least one of a portion of the dip tube, a portion of the adaptor, and a portion of the neck 40. The dip tube and the valve assembly are in fluid communication.

As illustrated in FIGS. 5A and 5B, the valve body 54 may include one or more members that extend from at least one of a first valve body surface 96 and a second valve body surface 98. The valve body 54 may include a first brace member 162. The first brace member 162 may be joined to the first valve body surface 96 and extend away from the first valve body surface 96. The first brace member 162 may extend continuously or discontinuously about the inner passageway 74. The first brace member 162 may be positioned adjacent to the outer surface 72 of the valve body 54. The first brace member 162 may be positioned between the outer surface 72 and the inner passageway 74 of the valve body 54. The first brace member 162 may extend in a direction away from the first valve body surface 96. The first brace member 162 may extend such that the outer most portion of the first brace member 162 extends above at least a portion of the resilient member 58. The first brace member 162 may extend above or be at the same height as the top of the valve stem. The first brace member 162 may provide stability to the valve body 54 when subject to relatively high temperatures and/or pressures, for example. An actuator or other dispensing component may be joined to a portion of the first brace member 162.

The valve body 54 may include a second brace member 164. The second brace member 164 may be joined to the first valve body surface 96 and extend away from the first valve body surface 96. The second brace member 164 may be positioned between the outer surface 72 and the inner passageway 74 of the valve body 54. The second brace member 164 may extend continuously or discontinuously about the inner passageway 74. The second brace member 164 may be positioned between the first brace member 162 and the inner passageway 74 of the valve body 54. The second brace member 164 may extend in a direction away from the first valve body surface 96 such that the outer most portion of the second brace member 164 extends above a portion of the resilient member 58. The second brace member 164 may extend above or be at the same height as the top of the valve stem. The second brace member 164 may provide stability to the valve body 54 when subject to relatively high temperatures and pressures, for example. An actuator or other dispensing component may be joined to a portion of the first brace member 162 or the second brace member 164.

The second brace member 164 may function to aid in guiding the engagement member 68 and/or the resilient member 58 as the valve stem 62 moves between the closed configuration and the open configuration. The second brace member 164 may substantially surround the engagement member 68 and/or the resilient member 58 such that the engagement member 68 may slidably move and the resilient member 58 may move, such as by deflecting or compressing. A gap may be present between the second brace member 164 and the engagement member 68. The engagement member 68 may slidably engage a portion of the brace member 164.

The valve body 54 may include one or more ribs. A rib 166 may extend between the first brace member 162 and the second brace member 164. The rib 166 may be joined to at least one of the first brace member 162 and the second brace member 164. As illustrated in FIG. 5A, the rib may be joined to both of a portion of the first brace member 162 and a portion of the second brace member 164. The rib may extend radially between the first brace member 162 and the second brace member 164. The rib 166 may be joined to the first valve body surface 96. The rib 166 may not be joined to the first valve body surface 96 and, thus, a gap may be present between the first valve body surface 96 and the rib 166. The one or more ribs 166 may aid in manufacturing the aerosol dispenser. For example, the one or more ribs 166 may be used to grip the valve body 54 such that the valve body 54 may be moved and/or attached to the container 32. The one or more ribs 166 may be operatively engaged by processing equipment during the manufacture of the aerosol dispenser. The one or more ribs 166 may allow for joining, such as by spin welding, the valve body 54 to the container 32. The one or more ribs 166 may also provide structural stability to the valve body 54. The one or more ribs 166 may aid in controlling the deformation of the valve body 54 such as when the aerosol dispenser is subject to relatively high temperatures, for example.

As illustrated in FIGS. 5A and 5B, the valve body 54 may include one or more protrusions that extend from at least one of the first valve body surface 96 and the second valve body surface 98. The valve body 54 may include a first attachment protrusion 168. The first attachment protrusion 168 may be joined to the second valve body surface 98 and extend away from the second valve body surface 98. The first attachment protrusion 168 may extend continuously or discontinuously about the inner passageway 74. The first attachment protrusion 168 may extend continuously or discontinuously about the longitudinal axis 70. The first attachment protrusion 168 may extend from the outer surface 72 of the valve body 54 towards the inner passageway 74. The first attachment protrusion may be positioned between the outer surface 72 and the inner passageway 74 of the valve body 54 or the longitudinal axis 70. The first attachment protrusion 168 may be configured to join the valve body to a portion of the neck of the container 32. The first attachment protrusion 168 may be welded to a portion of the neck of the container 32. It is to be appreciated that first attachment protrusion may be joined to the neck such as by a press fit, interference fit, solvent welding, laser welding, sonic welding, ultrasonic welding, spin welding, adhesive, or any combination thereof. The height and width of the first attachment protrusion 168 may be selected to obtain a desired weld between the valve body and the container 32. Generally, the greater the surface area the greater the strength of the weld. The first attachment protrusion 168 may include one or more grooves or other surface profile such that fluid may pass between a portion of the first attachment protrusion 168 and the neck prior to the valve body being sealed to the container 32.

As illustrated in FIGS. 5A and 5B, the valve body 54 may include a second attachment protrusion 170. The second attachment protrusion 170 may be joined to the second valve body surface 98 and extend away from the second valve body surface 98. The second attachment protrusion 170 may extend continuously or discontinuously about the inner passageway 74. The second attachment protrusion 170 may extend continuously or discontinuously about the longitudinal axis 70. The second attachment protrusion 170 may extend from the outer surface 72 of the valve body 54 towards the inner passageway 74. The second attachment protrusion 170 may be positioned between the outer surface 72 and the inner passageway 74 of the valve body 54 or the longitudinal axis 70. The second attachment protrusion 170 may be positioned between the first attachment protrusion 168 and the inner passageway 74 of the valve body 54 or the first attachment protrusion 168 and the longitudinal axis 70.

The second attachment protrusion may have a height that is greater than, less than, or equal to the height of the first attachment protrusion. The difference in height of the first attachment protrusion and the second attachment protrusion may allow for the valve body to be supported by the second attachment protrusion, which engages a portion of the neck of the container 32, while fluid, which may include product and/or propellant, is passed between the neck of the container 32 and the first attachment protrusion. The second attachment protrusion may form a temporary seal with a portion of the neck of the container 32 or the product delivery device to control the flow of fluid into the container 32. The second attachment protrusion 170 may be welded to a portion of the neck of the container 32 or a portion of the product delivery device 56. It is to be appreciated that the second attachment protrusion may be joined to the neck such as by a press fit, interference fit, solvent welding, laser welding, sonic welding, ultrasonic welding, spin welding, adhesive, or any combination thereof.

The first attachment protrusion 168 and the second attachment protrusion 170 may be spaced from one another such that a gap is present between them. This gap may allow for control of material when the first attachment protrusion 168 and the second attachment protrusion 170 are joined to the neck of the container 32. For example, when the valve body 54 is welded, such as by spin welding, the material of the first attachment protrusion 168 and the second attachment protrusion becomes semi-fluid and may flow and generate flash. Flash is the excess material that flows outside of the region of the attachment area. Similarly, when the valve body is joined by an adhesive, the adhesive may overflow also generating flash. The gaps control the flow of flash. The flash moves into the gaps and prevent the flash from interfering with the valve body 54 and/or the container 32.

The valve body 54 may include a valve skirt 172. The valve skirt 172 may be joined to the second valve body surface 98 and extend away from the second valve body surface 98. The valve skirt 172 may extend continuously or discontinuously about the inner passageway 74. The valve skirt 172 may extend continuously or discontinuously about the longitudinal axis 70. The valve skirt 172 may be positioned between the outer surface 72 and the inner passageway 74 of the valve body 54 or the longitudinal axis 70. The valve skirt 172 may be positioned between the first attachment protrusion 168 and the inner passageway 74 of the valve body 54 or the longitudinal axis 70. The valve skirt 172 may be positioned between the second attachment protrusion 170 and the inner passageway 74 of the valve body 54 or the longitudinal axis 70. The valve skirt may be used to prevent material from interfering with the movement and operation of the valve assembly. The valve skirt may be used to prevent flash from mixing with the product and/or propellant. The valve skirt, for example, may prevent flash generated during the welding or adhering process from interfering with the movement and operation of the valve stem and the dispensing and/or filling of product and/or propellant. The valve skirt may control the flash such that the flash is contained in the area between the valve skirt and the outer surface of the valve body. It is to be appreciated that the valve skirt may or may not be present, and this may be dependent on the type and geometry of the product delivery device 56 and the means for joining the valve assembly to the container. The valve skirt 172 may be configured to operatively engage a portion of the adaptor, the dip tube and/or the bag.

The aforementioned components of the aerosol dispenser 30 may be polymeric. By polymeric it is meant that the component is formed of a material that includes polymers, and/or particularly polyolefins, polyesters or nylons, and more particularly PET, PP, or PE. Thus, the entire aerosol dispenser 30 or, specific components thereof, may be free of metal. The container 32, and all other components, may comprise, consist essentially of or consist of PET, PEF, PEN, Nylon, EVOH, TPE (thermoplastic elastomer) or combinations thereof. All or substantially all of the components of the aerosol dispenser, excluding the propellant and product, may be configured to be accepted in a single recycling stream. All such materials, or a majority of the components of the aerosol dispenser 30 (excluding the propellant and product) may be comprised of a single class of resin according to ASTM D7611. Particularly, the majority of the aerosol dispenser 30 by weight may be PET. The majority of the valve assembly by weight may be PET.

A permanent or semi-permanent seal may be used to join any or all of the polymeric components of the aerosol dispenser 30. Particularly, if the components have compatible melt indices, such components may be sealed by welding to retain propellant therein. Suitable welding processes may include sonic, ultrasonic, spin, and laser welding. Welding may be accomplished with a commercially available welder, such as available from Branson Ultrasonics Corp. of Danbury, Connecticut.

It is to be appreciated that any method of joining the valve to the container 32 to seal product and/or propellant within the container 32 may be used. However, for the sake of brevity, the following discussion will discuss welding, and, more specifically, spin welding. Spin welding provides the benefit that the energy plane is generally confined to a small vertical space, limiting unintended damage of other components not intended to be welded or receive such energy. Spin welding further provides the benefit that the welding of the valve assembly to the container 32 and the welding of the product delivery device 56 may occur simultaneously or nearly at the same time, increasing production speed.

The process of manufacturing an aerosol dispenser may include blow molding the container 32 and molding, such as by injection molding, the components of the valve assembly. The process also includes joining the valve assembly to the container 32 and introducing product and propellant into the container. Further, an actuator may be joined to the valve assembly and/or the container 32 to allow for controlled dispensing of the product and/or propellant. More specifically, the process for joining the valve assembly to the container 32 and introducing product and propellant into the container 32 may include: providing the valve assembly, a product delivery device, such as a bag, and a container; disposing at least a portion of the product delivery device and at least a portion of the valve assembly within the opening of the neck of the container; forming a temporary seal between a portion of the neck and the product delivery device; introducing propellant into the container; joining the valve assembly to the container to seal the valve to the container such that propellant is sealed within the container; and controlling the position of the product delivery device during the joining of the valve assembly to the container such that the product delivery device does not, for example, interfere with the integrity of the seal between the valve assembly and the container or damage the product delivery device.

As previously discussed, the product delivery device may be a bag. The bag may be concentrically blow molded with the container 32, such as described in U.S. Pat. No. 10,220,562 and U.S. Patent Publication No. 2018/0043604, or the bag 24 may be provided separately from the container 32. The bag 24 may be made from a relatively flexible material, such that when propellant is introduced within the container 32, the bag may collapse. Similarly, the bag may deform as product is introduced into and dispensed from the bag. Due to the ability for the bag to collapse and deform, the bag position may need to be controlled to prevent the bag from interfering with the joining of the valve assembly to the container 32 and from damaging the bag during the manufacturing process.

At least a portion of the bag 24 and at least a portion of the valve assembly 52 may be disposed within the container 32. A portion of the bag 24 may be positioned between a portion of the container 32 and the valve body 54 of the valve assembly 52. More specifically, a portion of the bag 24 may be disposed on the second support surface 126 of the container 32. The second attachment protrusion 170 of the valve body 54 may be disposed on the portion of the bag 24 disposed on the second support surface 126 of the container 32. The first attachment protrusion 168 may be positioned above the first support surface 124, such that a gap is present between the first attachment protrusion 168 and the first support surface 124. The gap includes any opening that allows a fluid, such as propellant, to flow between the valve body 54 and the container 32.

Figure 6B:
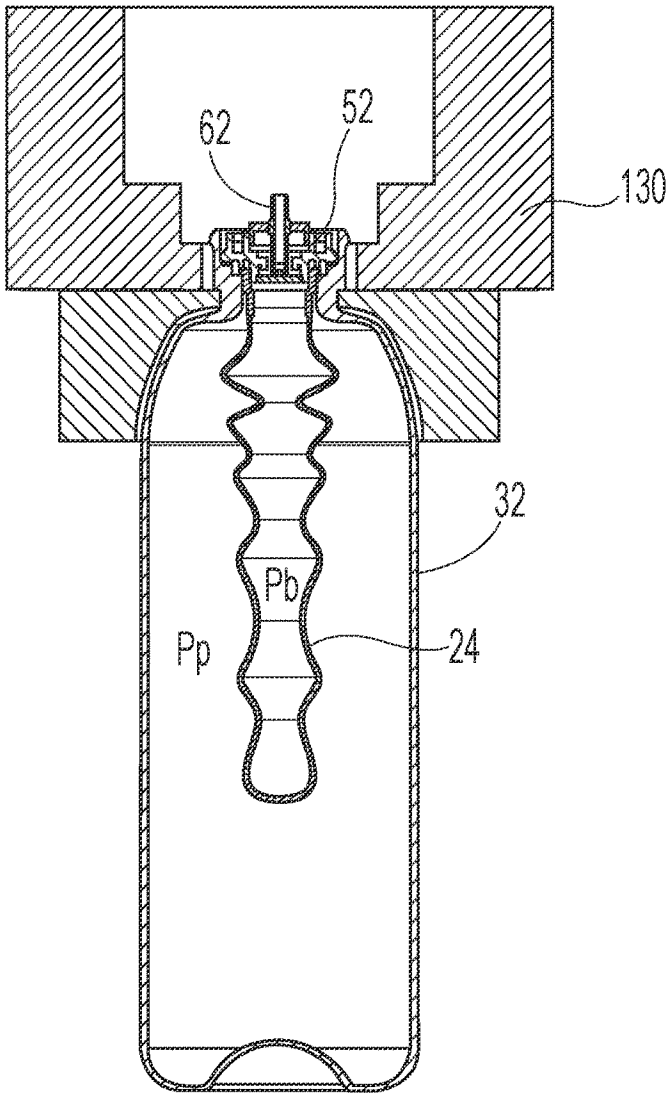
FIG. 6B is a sectional, side view of a manifold operatively engaged with at least a portion of at least one of the valve assembly and the container.
Figure 6A:
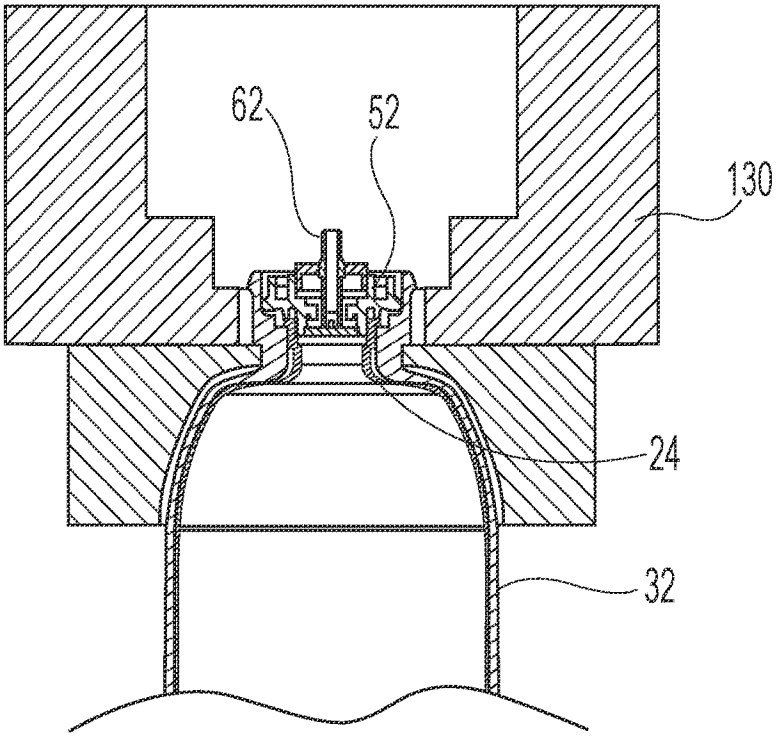
FIG. 6A is a partial sectional view of a manifold operatively engaged with at least a portion of at least one of the valve assembly and the container.

A manifold, a device configured to supply fluid, such as propellant, may be provided. The manifold may operatively engage at least a portion of the container 32 and the valve assembly 52 to form a seal, such as illustrated in FIGS. 6A and 6B. When the manifold operatively engages the container 32 and/or the valve assembly 52, a certain amount of force may be applied to the valve assembly 52. Upon operative engagement of the manifold to the valve assembly 52, a temporary seal may be formed between the valve assembly 52 at least one of a portion of the neck of the container 32 and a portion of the bag 24. The temporary seal prevents propellant from being introduced into the interior of the bag and allows propellant to be introduced into the container 32 in the area between the container 32 and the bag.

The manifold may supply propellant, under pressure, between the valve assembly 52 and container neck 40. The manifold may be retractingly disposed above the container 32. The manifold may be brought into contact with the valve assembly 52, to form the temporary seal. The geometry of at least one of the valve assembly 52 and the neck 40 of the container 32 may be such that the propellant may flow between the valve assembly 52 and the neck 40 and into the container 32. For example, at least one of the valve assembly 52 and the neck 40 may include one or more channels, grooves, or notches. The propellant may be supplied through or between the one or more channels, grooves, or notches. Suitable channels may include those described in commonly assigned U.S. Pat. No. 8,869,842. While the temporary seal is established, the propellant may be introduced into the outer container 32.

It is to be appreciated that the manifold may be configured to engage only the outer container 32. A separate device may be used to apply a force to the valve assembly 52 to form the temporary seal between the valve assembly 52 and at least one of the container and the product delivery device.

A bag 24 may be disposed within the container 32 prior to introducing propellant into the container. The bag 24 disposed in the container 32 has a first bag volume and the pressure within the bag is equal to atmospheric pressure or the pressure outside of the container. Upon formation of the temporary seal between the valve assembly and at least one of the container 32 and the bag 24 and as propellant is introduced into the container 32, the volume and pressure of the bag 24 change. To achieve the desired pressure between the container and the bag, the bag may collapse to a second volume, which is less than the initial, first bag volume. During the collapse of the bag, the volume of fluid within the bag may be controlled such that a desired pressure within the container and within the bag is achieved and/or a certain volume may be retained within the bag. A certain volume of fluid may be retained within the bag prior to joining the valve assembly to the container so that the bag does not adversely interfere with the seal between the valve assembly and the container and the bag does not get damaged during the joining of the valve to the container. If a volume of fluid is retained within the bag prior to joining of the valve to the container, that volume of fluid may be released from the bag through the valve stem after the joining of the valve to the container or prior to filling the bag with a product. Minimizing the fluid within the bag prior to filling the bag with product may prevent dispensing of unwanted fluid, such as air, with the product.

It is to be appreciated that bags that are rolled and secured prior to placement into a container, likely do not have enough volume to interfere with pressurizing the container, through the introduction of propellant. Further, a bag that is rolled and secured in the rolled orientation is unlikely to interfere with the joining of the valve to the container as the bag is in a secured orientation that provides enough rigidity to prevent movement of the bag into a position that interferes with this process.

As the propellant is being introduced into the container 32, the valve stem 62 may be manipulated such that the volume and pressure within the bag may be controlled in various ways. More specifically, the methods to control the pressure and/or volume in the bag during and/or after the introduction of propellant include: blocked venting, vent profiling, slow venting, vent gassing and pressurized joining, negative pressure to blocked vent, and open vent to closed volume. These will be discussed in more detail herein with reference to FIGS. 6 and 7. During one or more of these methods, the bag may have a first bag volume and a second bag volume. The first bag volume may be different than the second bag volume. The first bag volume may be greater than the second bag volume. The second bag volume may be from about 0.1% to about 5% or from about 1% to about 5% or from about 5% to about 50% of the volume of the container, also referred to as the internal container volume. The first bag volume may be greater than about 20% of the internal container volume and the second bag volume may be less than about 15% of the internal container volume. The bag may have a first bag pressure prior to propellant being introduced into the container and a second bag pressure after propellant is introduced into the container. The first bag pressure may be different from the second bag pressure. The first bag pressure may be less than the second bag pressure.

Using the blocked vent method to control the pressure and/or volume of the bag includes the following. As the propellant is being introduced into the container 32, the valve stem 62 may be positioned in a closed configuration. A closed configuration means that fluid is unable to flow through the valve stem. The valve stem 62 may remain in the closed configuration for the duration of the introduction of propellant into the container. The fluid that is present within the bag when the temporary seal is formed remains trapped within the bag 24 and is compressed as propellant is introduced into the container 32. The bag pressure Pb, which is the pressure within the bag 24, will equilibrate with the propellant pressure Pp, which is the pressure of the propellant between the container and the bag, and the bag 24 will be collapsed. The first or initial volume of the bag may be greater than the second volume of the bag after the introduction of propellant. Stated another way, the volume of the bag is decreased. After joining the valve assembly to the container, the volume of fluid within the bag may be released through the valve stem by positioning the valve stem in the open configuration.

Using the vent profiling method to control the pressure and/or volume of the bag includes the following. The valve stem 62 may be cycled between a closed configuration and an open configuration. The open configuration allows fluid to flow through the valve stem. As the propellant is being introduced into the container 32, the valve stem 62 may be cycled any number of times from the closed configuration to the open configuration. The number of cycles and the duration of the cycles may be determined, in part, based on the type of propellant and the characteristics of the aerosol dispenser, such as the container volume and pressure of the propellant and orifice dimensions disposed on the valve stem. For example, the valve stem 62 may be cycled from the open configuration to the closed configuration, or vice versa, once. The bag is compressed as propellant is introduced into the container 32. As propellant is being introduced into the container, fluid is allowed to be released from the bag through the valve stem when the valve stem is in the open configuration. The bag 24 collapses as the propellant is introduced into the container and fluid is cyclically released through the valve stem. The bag may have a first volume prior to propellant being introduced into the container and a second volume once propellant has been introduced into the container and an amount of fluid has been released from the bag. The first volume may be greater than the second volume. The bag pressure Pb will equilibrate with the propellant pressure Pp between the bag and the bottle. The valve stem 62 may be returned to the closed configuration prior to completion of the introduction of propellant into the container. A predetermined amount of fluid remains within the bag. The retention of some fluid within the bag prevents the bag from being fully collapsed and, thus, the bag is not fully collapsed. By preventing the bag from fully collapsing, the bag is prevented from interfering with the joining of the valve assembly and the container. The bag retains enough volume that the bag is not in contact with the valve assembly. After joining the valve assembly to the container, the volume of fluid within the bag may be released through the valve stem by positioning the valve stem in the open configuration.

Using the slow venting method to control the pressure and/or volume of the bag includes the following. A flow restrictor may be joined to the valve stem 62 to control the release of fluid through the valve stem as propellant is being introduced into the container 32. The flow restrictor controls the amount that the bag collapses and the rate at which the bag collapses. The flow restrictor may be connected to or be an integral part of the manifold. The valve stem 62 may be positioned in an open configuration during the introduction of propellant. The flow restrictor allows for a certain amount of fluid to be released during this process. The flow restrictor may be configured to allow a substantially constant flow of fluid to be released through the valve stem. The flow restrictor may be configured to allow a flow of fluid to be released for less than the duration of the introduction of propellant into the container or for substantially the same duration as the introduction of propellant into the container. The flow restrictor may be configured to allow for a flow rate of fluid to be released that is less than the rate of introduction of propellant or substantially the same as the rate of introduction of propellant. The valve stem 62 may be returned to the closed configuration upon completion of the introduction of propellant into the container and/or once the desired amount of fluid is release through the valve stem. The bag may be compressed as propellant is introduced into the container 32. As propellant is being introduced into the container and fluid is allowed to be controllably removed from the bag through the valve stem, the volume within in the bag is changed. The bag may have a first volume prior to propellant being introduced into the container and a second volume once propellant has been introduced into the container and the desired amount of fluid has been released from the bag. The bag pressure Pb will equilibrate with the propellant pressure Pp, the pressure between the bag and the bottle. A predetermined amount of fluid may remain within the bag to prevent the bag from fully collapsing. By retaining an amount of fluid within the bag, the bag is prevented from interfering with the joining of the valve assembly and the container. The bag retains enough volume that the bag does not contact the valve assembly. After joining the valve assembly to the container, the volume of fluid within the bag may be released through the valve stem by positioning the valve stem in the open configuration.

Using the vent gassing and pressurized joining method to control the pressure and/or volume of the bag includes the following. The valve stem 62 may be positioned in an open configuration during the introduction of the propellant into the container. As propellant is introduced, the fluid within the bag is released through the valve stem. The bag may be fully collapsed. Upon being collapsed, the bag may contact the valve assembly 52. If the bag is collapsed such that the bag is in contact with the valve assembly 52, a fluid may be introduced through the valve stem at a pressure greater than the propellant pressure Pp, the pressure between the bag and the container. The introduction of pressurized fluid expands the bag such that the bag moves away from the valve assembly and is no longer in contact with the valve assembly. By positioning the bag away from the valve assembly, the bag may not interfere with the joining of the valve assembly to the container. After joining the valve assembly to the container, the volume of gas within the bag may be released through the valve stem by positioning the valve stem in the open configuration. It is to be appreciated that if the bag collapses to a greater extent than is expected or collapses such that the bag may interfere with the joining process in any of the described methods, a fluid may be introduced through the valve stem to move the bag away from the valve assembly.

Using the negative pressure to blocked vent method to control the pressure and/or volume of the bag includes the following. The valve stem 62 may be positioned in an open configuration. While the valve stem 62 is in the open configuration, a negative pressure is pulled through the valve stem 62. The pressure may be from about 1 psia to about 15 psia. The pressure may be reduced until the pressure within the bag is from about 5 psia to about 10 psia. Maintaining a pressure of greater than about 5 psia within the bag may prevent the bag from fully or partially collapsing. As the negative pressure is being applied, the bag may collapse from a first bag volume to a second bag volume. The difference between the first bag volume and the second bag volume may be less than about 5%. The second bag volume may be greater than about 95% of the first bag volume. After the desired pressure within the bag is reached, the valve stem 62 may be positioned in the closed configuration. Once the valve stem is in the closed configuration, propellant may be introduced into the container between the valve assembly 52 and the container. By starting the introduction of propellant when the bag has a relatively lower pressure, the bag may collapse further before the bag pressure Pb, the pressure within the bag, and the propellant pressure Pp, the pressure between the bag and the container, reaches equilibrium. The bag 24 may collapse from the second bag volume to a third bag volume. The third bag volume may be less than the second bag volume. The third bag volume may be less than the first bag volume. Propellant may be introduced between the bag 24 and the container until the bag pressure Pb and the propellant pressure Pp equilibrate. After the bag pressure and the propellant pressure reach equilibrium, the valve assembly 52 may then be joined to the container. After joining the valve assembly to the container, the volume of gas within the bag may be released through the valve stem by positioning the valve stem in the open configuration.

Figure 7B:
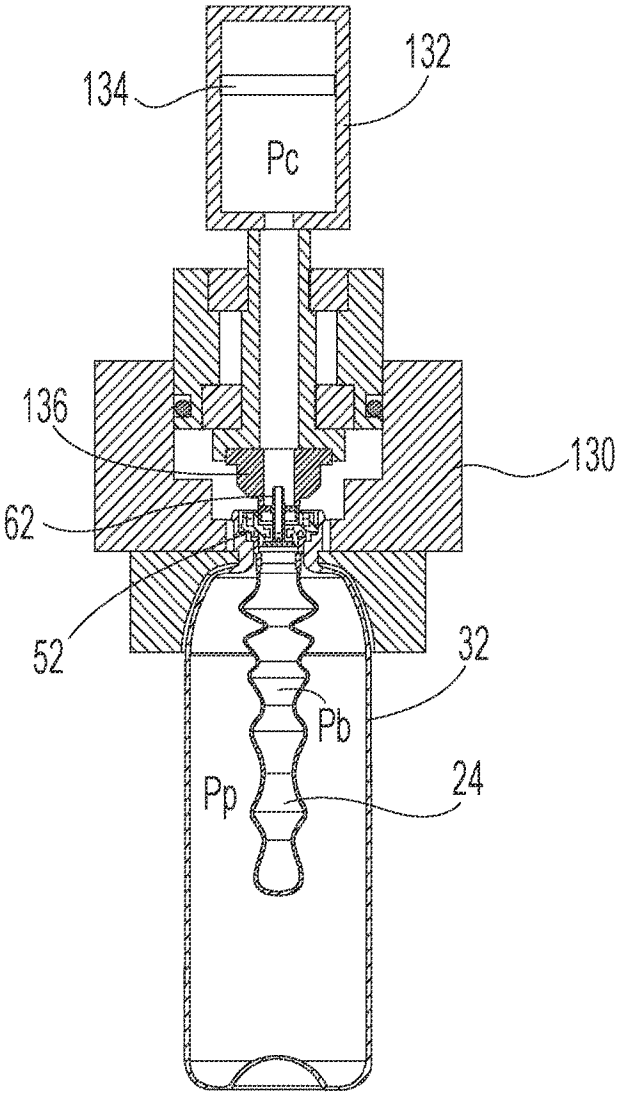
FIG. 7B is a sectional view of a manifold operatively engaged with at least a portion of at least one of the valve assembly and the container and a fluid chamber operatively engaged with the valve assembly.
Figure 7A:
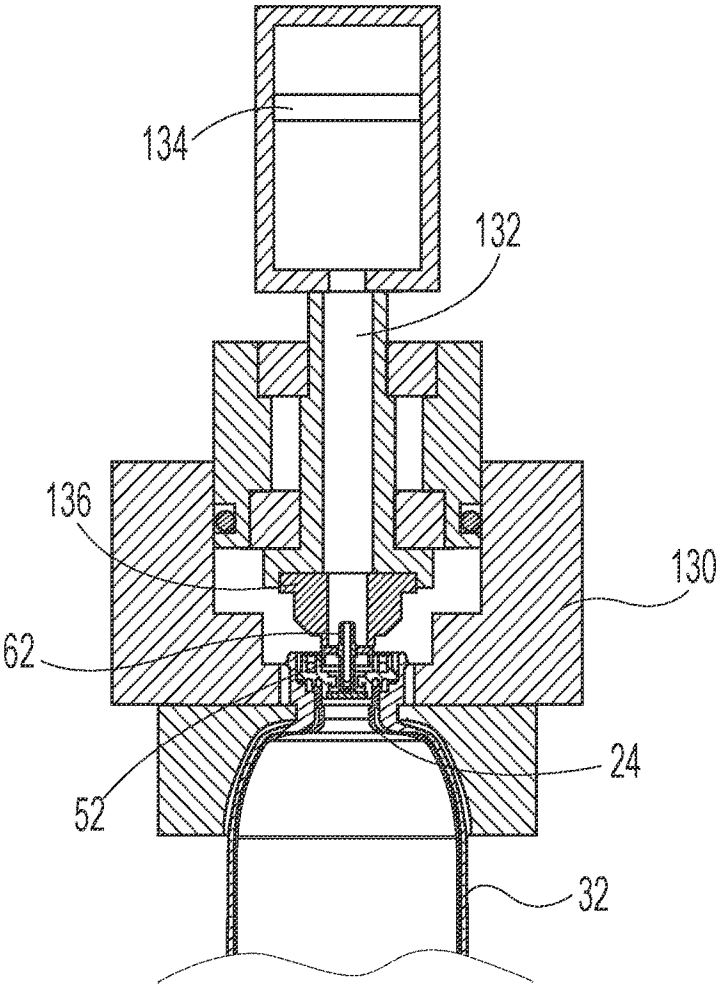
FIG. 7A is a partial, side view of a manifold operatively engaged with at least a portion of at least one of the valve assembly and the container and a fluid chamber operatively engaged with the valve assembly.

Using the open vent to closed volume method to control the pressure and/or volume of the bag includes the following. Once the valve assembly 52 is disposed on the container 32, a manifold 130, as previously described, and a fluid chamber 132 may be provided, such as illustrated in FIGS. 7A and 7B. The fluid chamber may be connected to or be an integral part of the manifold. The manifold 130 and the fluid chamber 132 may be positioned to contact at least a portion of at least one of the valve assembly 52 and the container 32. The manifold 130 and the fluid chamber 132 may form a hermetic seal, which is a fluid tight seal, with at least a portion of at least one of the valve assembly 52 and the container 32. The fluid chamber may be moveable with respect to the valve assembly 52. The fluid chamber 132 may include a valve engagement tip 136. The valve engagement tip 136 may be configured to operatively engage the valve stem 62. The valve engagement tip 136 may move the valve stem 62 to the open configuration when operatively engaged with the valve stem and may allow the valve stem 62 to return to a closed configuration when the valve engagement tip 136 is moved away from the valve stem 62. When the valve stem 62 is in the open configuration, a fluid path from the bag 24, through the valve stem 62, and into the fluid chamber 132 is formed. It is to be appreciated that the valve engagement tip 136 may operatively engage the valve stem 62 or another component of the valve assembly that is joined to the valve stem 62, such as the engagement member 68.

The fluid chamber 132 may substantially surround the valve stem 62 and may be in fluid communication with the valve stem 62 such that any fluid that is expelled through the valve stem 62 is retained within the fluid chamber 132. The fluid chamber 132 may be sized to hold a certain volume of fluid. The size of the fluid chamber 132 may be based, at least in part, on the volume of the container, the volume of the bag, and the desired pressure between the container and the bag. The fluid chamber 132 may be sized such that the ratio of the volume of the collapsed bag (the bag after propellant is introduced into the container) and the volume of the container is from about 0.1% to about 5% or from about 1% to about 5% or from about 5% to about 50%. The fluid chamber 132 may be sized such that a certain amount of fluid remains within the bag as the bag is collapsed due to the introduction of propellant into the container. The fluid chamber may have a fluid chamber volume that is variable or a fixed. For example, the fluid chamber may include a piston 134. The piston 134 may be disposed within the fluid chamber 132 and is moveable within the fluid chamber 132. The volume of the fluid chamber 132 may be adjusted by moving the piston 134. Thus, the volume of the fluid chamber 132 may be adjusted for different sizes of containers 32 and to achieve different volumes/pressures within the bag 24 and the container 32. The fluid chamber volume may be less than the internal container volume. The fluid chamber volume may be from about 30% to about 40% of the container volume or from about 20% to about 50% of the container volume or from about 10% to about 60% of the container volume. After joining the valve assembly to the container, the volume of gas within the bag may be released through the valve stem by positioning the valve stem in the open configuration.

The manifold 130 and the fluid chamber 132 operatively engage at least a portion of at least one of the valve assembly 52 and the container 32. The manifold 130 and the fluid chamber 132 are hermetically sealed to at least a portion of at least one of the valve assembly 52 and the container 32. The valve stem 62 is moved from a closed configuration, to an open configuration. The open configuration allows fluid to move from the bag, through the valve stem, and into the fluid chamber. The manifold 130 introduces propellant into the container 32. The propellant may be introduced between the container 32 and the bag 24. The valve stem 62 remains in an open configuration as propellant is introduced into the container. As propellant is introduced into the container 32, the pressure within the container increases. As the pressure within the container increases, a portion of the fluid volume is expelled from the bag by moving from the bag, through the valve stem 62, and into the fluid chamber 132. Because the fluid chamber 132 is a closed volume, only a certain amount of fluid may flow into the fluid chamber 132. The fluid chamber 132 is sized such that the complete volume of fluid within the bag cannot be expelled from the bag and into the fluid chamber. The fluid chamber 132 is sized such that a certain volume of fluid remains within the bag. The first volume of the bag prior to introduction of propellant into the container may be greater than the second volume of the bag after introduction of propellant. Upon introduction of propellant into the container, the bag pressure Pb will equilibrate with the chamber pressure Pc, the pressure of the fluid within the fluid chamber. Further, the bag pressure Pb will reach an equilibrium with the propellant pressure Pp. Stated another way, equilibrium is obtained when the propellant pressure Pp, the bag pressure Pb, the chamber pressure Pc, the pressure of the fluid within the fluid chamber, are substantially equal. The bag may be partially collapsed but not fully collapsed when an equilibrium of the pressures is reached. Stated another way, the bag still has a volume, which may be relatively small, to prevent the bag from interfering with the joining of the valve assembly to the container when equilibrium is reached. It is to be appreciated that increasing the size of the fluid chamber 132, will allow the bag to collapse further and decreasing the size of the fluid chamber, will allow the bag to collapse less. Once equilibrium is obtained, the manifold discontinues providing propellant to the container, the valve stem 62 may be returned to a closed configuration, and the valve assembly 52 may be joined to the container 32. It is to be appreciated that the valve stem 62 may remain in an open configuration as the valve assembly 52 is joined to the container 32. The valve stem 62 may be moved from the open configuration to the closed configuration after the valve assembly 52 is joined to the container 32. The manifold 130 and the fluid chamber 132 may be removed from contacting the container 32 and/or the valve assembly 52. The valve stem 62 may be moved from the closed configuration to the open configuration to release any fluid that was remaining in the bag 24 after joining.

For any of the aforementioned methods, product and an actuator may be added to the container and/or valve assembly 52 after the valve assembly 52 is joined to the container. The container may be filled with product by introducing product through the valve stem 62 such that product flows through the valve stem 62 and into the bag 24 or the container 32. Product may flow through the valve stem 62 while the valve stem is positioned in an open configuration. An actuator may be joined to a portion of at least one of the valve assembly 52 and the container 32.

Various methods may be used to join the valve assembly 52 to the container 32. A permanent or semi-permanent seal may be used to join the valve assembly 52 to the container 32. If the valve assembly 52, more specifically, the valve body 54, and the container 32, more specifically, the neck 40, have compatible melt indices, such components may be sealed by welding to retain the propellant therein. Suitable welding processes may include sonic, ultrasonic, spin, and laser welding.

As previously discussed, the valve body 54 includes a first attachment protrusion 168 and a second attachment protrusion 170. The container 32 includes a first support surface 124 and a second support surface 126. When the valve assembly 52 is disposed within at least a portion of the neck 40 of the container 32, the first attachment protrusion 168 may be aligned with the first support surface 124 and the second attachment protrusion 170 may be aligned with the second support surface 126. When the valve assembly 52 is joined to the container 32, the first attachment protrusion 168 may be joined to the first support surface 124 and the second attachment protrusion 170 may be joined to the product delivery device, such as a bag, an adaptor 64 joined to a bag, or an adaptor 64 joined to a dip tube, which is supported by the second support surface 126. The first attachment protrusion 168 may be joined to the first support surface 124 at the same time as or at a different from than the second attachment protrusion 170 may be joined to the bag 24. The second attachment protrusion 170 may be joined to the bag 24 prior to the first attachment protrusion being joined to the first support surface 124.

It is to be appreciated that the second support surface 126 may be joined to the second attachment protrusion 170 and/or the product delivery device. For example, if a relatively high amount of frictional energy, such as by spinning the valve, is delivered to the area of the second support surface 126, the second support surface 126 may become molten and join to the second attachment protrusion 170 and/or the product delivery device 56, such as the bag 24, the dip tube 26, an adaptor 64 joined to a bag, or an adaptor 64 joined to a dip tube.

When welding the valve assembly 52 to the container 32, the first attachment protrusion 168 may be joined to the first support surface 124 at a first weld 88 and the second attachment protrusion may be joined to the product delivery device at a second weld 90, such as illustrated in FIG. 5B. As previously stated, the second support surface 126 may also form part of the second weld 90. The second weld 90 may occur prior to the first weld 88. The second weld 90 may occur at the position of the temporary seal between the valve assembly and at least one of the containers and the product delivery device. The temporary seal prevents propellant from being introduced into the bag as propellant is introduced into the container 32. After propellant has been introduced into the container 32, the second weld 90 may be completed, which provides for containment of the propellant within the container 32 and prevents propellant from entering the bag 24. The first weld 88 may be radially spaced from the second weld 90.

The timing of the second weld 90 occurring after, or preferably before the first weld 88 may be influenced by geometry of the first attachment protrusion 168 and the second attachment protrusion 170. If the protrusions equally contact the respective support surfaces, the second weld 90, and first weld 88 will generally simultaneously occur. However, the second attachment protrusion 168, which engages a portion of the bag 24, may extend further than the first attachment protrusion 168, so that welding order allows for propellant to be introduced between the valve body 54 and the neck 40 of the container 32 as described herein.

If the product delivery device 56 is a dip tube 26, the introduction of propellant and the introduction of product may simultaneously occur. The propellant and product may be premixed so that it may be introduced together, which occurs during the welding operation. Alternatively, either a bag 24, piston, or a dip tube 26 aerosol dispenser 20 may have the product 42 later added through the valve stem 62.

It is to be appreciated that if one or more of the first weld 88 and the second weld 90 are relatively thick in the radial dimension, and spaced relatively close to each other, the first weld 88 and the second weld 90 may appear to merge. While two radially spaced apart welds are discussed, any number of welds may be utilized. Additional welds may be used to join additional components as desired or to reinforce the first weld 88 and the second weld 90.

The first weld 88 may circumscribe the second weld 90 in concentric or eccentric fashion. The first weld 88 and the second weld 90 may be of equal or unequal radial thickness, require equal or unequal energy to affect a proper bond, and may be equally or unequally spaced from each other and equally or unequally spaced about the longitudinal axis. The first weld 88 and the second weld 90 may be in the same plane or in different planes. The first weld 88 and the second weld 90 may be of constant or variable thickness in the radial direction, in the same plane or mutually different planes with either being above or below the other, may be formed by the same process or different processes, may be perpendicular to or skewed to the longitudinal axis, and mutually eccentric and/or eccentric to the longitudinal axis.

The valve assembly 52 may be spin welded by rotation about the longitudinal axis. The valve assembly 52 may be subjected to relative motion. The valve assembly 52 may be rotated while the container 32 and the product delivery device 56 are held stationary. The container 32 and product delivery device 56 may be rotated about the longitudinal axis and the valve assembly 52 may be held stationary to join the valve assembly 52 to the container 32. Any difference in rotation between the valve assembly 52 and the outer container 32 and/or the product delivery device 56 that produces sufficient frictional energy to create a seal that contains the propellant and product within the container is suitable.

An external drive may be used to provide relative motion between the valve assembly 52, the product delivery device 56, and the container 32. The external drive may be vertically actuated to engage the ribs 166 of the valve body 54 to impart rotation to the valve assembly 54. Upon welding, the valve assembly 52 may move axially downward a distance corresponding to the melting of the protrusions 168, 170.

Generally, the aforementioned disclosure may be used in the gassing and welding of aerosol dispensers. A method for manufacturing multiple aerosol dispensers include a bag and container may include the following steps. Two or more containers including a bag may be advanced to a turret. The two or more containers may be advanced at a continuous or variable velocity. The two or more containers including a bag may be advanced by, for example, a star-wheel or conveyor. The bag and container are introduced onto the turret. A valve assembly may be disposed on at least a portion of the bag and/or the container prior to being introduced onto the turret or after being introduced onto the turret. The turret may rotate about an axis. Gassing and welding stations may be internal to or external to the turret. The gassing and welding stations may rotate with the turret or may be stationary with respect to the rotating turret. The gassing and welding station may perform a series of process steps outlined as follows: (1) gripping the container around the neck of the container (2) establishing a temporary seal between the valve engagement tip and valve (3) establishing a temporary seal between the gassing manifold and container neck (4) establishing a temporary seal between the valve and bag components (5) controlling the fluid, such as by removing the fluid from the headspace of gassing manifold and between the bag and the container (6) introducing fluid, such as a gas, by metering through, for example, a flowmeter (mass or volume or pressure) while controlling the bag collapse, such as the volume of the bag (7) rotating the valve with respect to the container and the bag to initiate melt flow of the materials for creating a weld (8) holding the valve stationary to the container and the bag to allow for a weld to form and solidify (9) using a computer, microprocessor, microcontroller, PLC, or other computing, automated infrastructure to perform calculations upon the welding response output, including torque, force, and position, to characterize the quality of the weld and flagging for rejection any container, bag, valve assembly where the weld does not meet desired quality standards. Upon completion of these steps, the turret would continue to transport the welded package, which includes the container, bag, and valve to an unloading turret position. At this position, the fully gassed and welded package would be released from the turret. The package may be released onto a device that transports the package away from the turret such as a conveyor, star-wheel, or other transfer device. A downstream process operation may fill product through the valve stem into the pressurized bag.

The aforementioned process of manufacturing multiple aerosol dispenser may also be done with a dip tube. The fluid may be introduced into the container to pressurize the container and product may be later introduced after the gassing and welding of the dip tube to the container. It is also to be appreciated that product and/or propellant may be introduced simultaneously. It is also to be appreciated that product may be introduced into the container prior to the container being gassed and welded. For example, product may be introduced into the container prior to the container and valve assembly, including a dip tube, being transferred to the turret where the gassing and welding are to be performed.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of making an aerosol container comprising:

providing a polymeric container having a closed end bottom and a neck longitudinally opposed to the closed end bottom, wherein the neck defines an opening, wherein the container has an internal container volume;

providing a valve and a bag, wherein at least a portion of the valve and the bag are disposed in the opening of the neck;

contacting a portion of at least one of the neck and the bag to a portion of the valve to form a temporary seal;

providing a fluid chamber having a fluid chamber volume;

engaging at least a portion of at least one of the valve and the container with the fluid chamber;

positioning the valve in an open configuration;

introducing a propellant into the container;

releasing a fluid from the bag through the valve and into the fluid chamber; and joining the valve to the container to seal the valve to the container, wherein the propellant is sealed within the container.

2. The method of claim 1, wherein the valve is positioned in the open configuration prior to introducing propellant into the container.

3. The method of claim 1, wherein the fluid chamber volume is variable.

4. The method of claim 1, wherein the fluid chamber comprises a piston.

5. The method of claim 4, comprising moving the piston from a first position to a second position.

6. The method of claim 1, wherein the fluid chamber volume is less than the internal container volume.

7. The method of claim 1, wherein the fluid chamber volume is from about 10% to about 60% of the internal container volume.

* * * * *